US007273049B2

(12) United States Patent
Yeung

(10) Patent No.: US 7,273,049 B2
(45) **Date of Patent: *Sep. 25, 2007**

(54) DUAL MOTOR KITCHEN RANGE HOOD WITH PERIMETER AIR INLET

(76) Inventor: Peter Yeung, 4446 Frances Street, Burnaby (CA) V5C 2R4

( * ) Notice: Subject to any disclaimer, the term of this patent is extended or adjusted under 35 U.S.C. 154(b) by 553 days.

This patent is subject to a terminal disclaimer.

(21) Appl. No.: 10/625,661

(22) Filed: Jul. 24, 2003

(65) Prior Publication Data

US 2005/0016522 A1 Jan. 27, 2005

(30) Foreign Application Priority Data

Jul. 3, 2002 (CA) ..... 2434852

(51) Int. Cl.
*F24C 15/20* (2006.01)

(52) U.S. Cl. ..... 126/299 E; 126/299 D; 454/58

(58) Field of Classification Search ..... 126/299 EO, 126/299 D, 299 C, 299 R; 454/58 X, 49
See application file for complete search history.

(56) References Cited

U.S. PATENT DOCUMENTS

| | | | | |
|---|---|---|---|---|
| 5,268,012 | A | 12/1993 | Jang | |
| 5,370,498 | A | 12/1994 | Klingler | |
| 5,372,122 | A | 12/1994 | Hong et al. | |
| 5,448,987 | A | 9/1995 | Jang | |
| 5,469,837 | A * | 11/1995 | Chiang et al. | 126/299 D |
| 5,537,988 | A | 7/1996 | Lin | |
| 5,628,289 | A | 5/1997 | Chang | |
| 5,979,436 | A | 11/1999 | Chiang et al. | |
| 6,401,709 | B1 | 6/2002 | Okamoto et al. | |
| 6,802,310 | B1 * | 10/2004 | Yeung | 126/299 D |
| 6,820,609 | B2 * | 11/2004 | Woodall et al. | 126/299 R |

FOREIGN PATENT DOCUMENTS

| | | |
|---|---|---|
| CN | 2158979 | 3/1994 |
| CN | 2530187 | 1/2003 |
| GB | 2 270 638 A | 3/1994 |

OTHER PUBLICATIONS

Search Report for Application No. GB0412292.5.*
Search Report for Application No. PCT/CN2004/000580.*

* cited by examiner

*Primary Examiner*—Alfred Basichas
(74) *Attorney, Agent, or Firm*—C. Larry Kyle; Nexus Law Group LLP

(57) ABSTRACT

A kitchen range hood for exhausting gases comprises an outer hood body within which a motor housing is mounted. The motor housing has top, bottom and perimeter side surfaces defining a pair of substantially similar air chambers, a motor and fan being housed in each chamber. An opening in the bottom surface of the housing is aligned below each of the fans. A tray is located in abutment with the housing below the opening in the bottom surface. The tray has a wall and a floor, with at least one air inlet opening in the wall. A bottom panel is connected to the bottom of the hood body about the tray. Air is drawn into the range hood through the air inlet in the tray wall. The range hood is also equipped with an automatic cleaning system, comprising a spray nozzle and hose seated above the floor of the tray.

10 Claims, 9 Drawing Sheets

DUAL MOTOR KITCHEN RANGE HOOD WITH PERIMETER AIR INLET

FIELD OF THE INVENTION

This invention relates to range hoods for use in domestic kitchens for exhausting smoke and gases above a cooking surface, and more particularly to a dual motor range hood adapted for drawing in air about the periphery of the range hood bottom.

BACKGROUND OF THE INVENTION

Kitchen range hoods are used above cooking surfaces to remove grease, common odors and hazardous gases created during the cooking process. There are a wide variety of range hoods available, but they typically comprise one or two openings formed in the bottom of the range hood and a comparable number of devices (motor and fan) for drawing the unwanted gases through the opening(s). In these designs, the fan and its respective motor are positioned above the opening and act to draw gases into the range hood through the opening.

The difficulty with both the single and the double opening designs is that not all of the gases rising from the cooking surface will be drawn through the opening(s). Some of the gases rising from the cooking surface flow around the sides or front of the range hood and remain present in the cooking environment.

A number of range hood designs have been developed to overcome this shortcoming. U.S. Pat. No. 5,448,987 teaches a range hood having two motors that has a lower plate spaced below the bottom of the range hood body. Locating members keep the lower plate spaced apart from the range hood so that the front, left and right sides of the lower plate form a smoke drawing space along with the bottom side of the range hood body. The lower plate is sloped from front to rear and has a hole located at its lowest point to allow any accumulated grease to drip through to a grease cup. Manual cleaning of the range hood is required. However, because the lower plate is fastened to the bottom of the range hood it is difficult to access the interior of the range hood for cleaning or other maintenance.

U.S. Pat. No. 5,979,436 teaches a range hood smoke exhauster having a peripheral air drawing effect. A pair of drawing devices (motors and fans) is mounted above openings in the range hood bottom. A plate is secured to the hood, spaced below the hood bottom. The plate has two openings that are aligned with the openings in the hood bottom and a number of slots or grooves in the peripheral portion of the plate to allow smoke in the area of the periphery of the plate to be drawn into the range hood. This design also requires manual cleaning and suffers from deficiencies related to cleaning, as accessing the interior of the motor housing is difficult.

A further design is taught in U.S. Pat. No. 6,401,709. The range hood has side plates extending below the body, each side plate having an inclined surface. A deflecting plate has a horizontal portion shaped in parallel with the bottom face of the range hood and an inclined portion aligning with the inclined surface of the side plates. The deflecting plate is spaced from the bottom face of the hood body so as to form an inlet port at the front and both sides and to form a suction passage. This range hood also requires manual cleaning of grease-laden surfaces. As with the previous designs, this cleaning is made more difficult by the presence of the deflecting plate, which interferes with access to the range hood interior.

Therefore, while each of the range hoods taught respectively in the '987, '436 and '709 patents provides a peripheral air drawing effect, they all require manual cleaning of the interior surfaces. Given the designs, this manual cleaning is very difficult to accomplish.

Accordingly, it is an object of an embodiment of the invention to provide a dual motor range hood adapted for drawing in air about the periphery of the range hood bottom.

It is a further object of an embodiment of the invention to provide a range hood adapted for drawing in air about the periphery of the range hood bottom that is self-cleaning.

Not all aspects of the invention necessarily address such objects. Other objects of the invention will be apparent from the description that follows.

SUMMARY OF THE INVENTION

According to the preferred embodiment of the present invention there is provided a range hood for exhausting gases comprising an outer hood body, a motor housing, a tray and a bottom panel. The motor housing has top, bottom and perimeter surfaces defining an enclosure and has an air outlet and at least one opening defined in the bottom surface. The motor housing is mounted within the hood body; and a motor and fan are mounted within the motor housing. The tray has a side wall, a floor and a drainage hole. There is at least one air inlet opening located in the side wall of the tray and the tray is in abutment with the motor housing located below the opening in the bottom surface. The bottom panel is releasably connected to the hood body and the tray projects through the bottom panel such that the air inlet is located below the bottom panel.

In another aspect, the tray further comprises an annular ring, the annular ring connecting to the motor housing.

In yet another aspect, the range hood described above further comprises spray dispensing means. The spray dispensing means preferably comprise a hose and spray nozzle, with the hose being seated in the side wall of the tray and the nozzle being positioned so as to direct cleaning fluid under pressure towards the fan and motor housing interior. The hose and nozzle may be further seated on a support stand projecting from the floor of the tray.

In another aspect, the tray wall has a plurality of said air inlets.

In yet another aspect, the range hood described above comprises two motors and two fans. The motor housing also comprises two substantially similar air chambers, each chamber having an opening defined in the bottom surface of the motor housing. A motor and fan is housed within each chamber above the chamber opening. The range hood may be equipped with a tray for each chamber opening, or have one tray adapted to encompass both of the chamber openings The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

The present invention relates to a kitchen range hood and in particular a range hood having dual motors and a peripheral air drawing effect such that grease filled air above a cooking surface may be drawn into the range hood to be exhausted to an external location.

Figure 1:
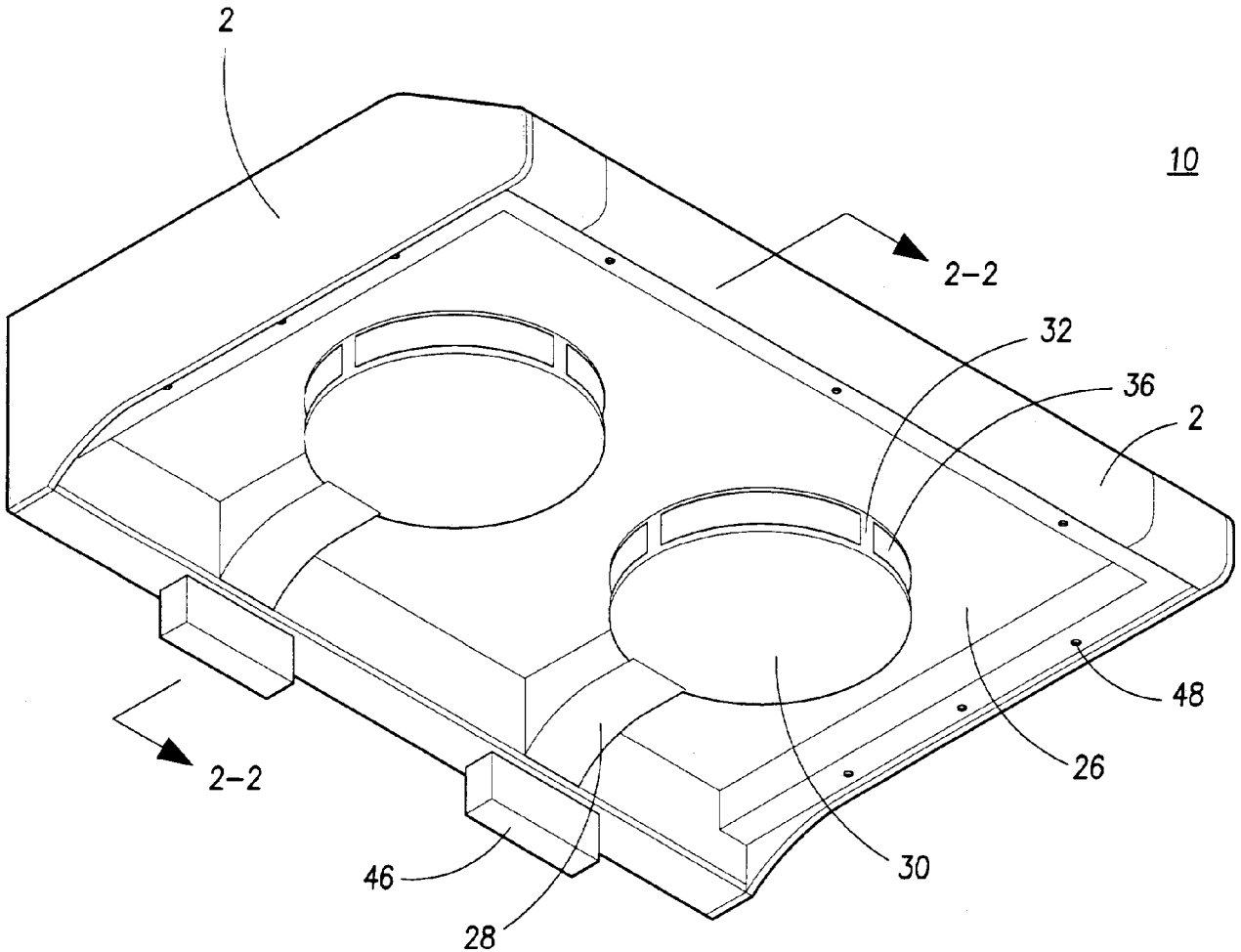
FIG. 1 is a perspective view from the bottom of a range hood according to the preferred embodiment of the invention.
Figure 2:
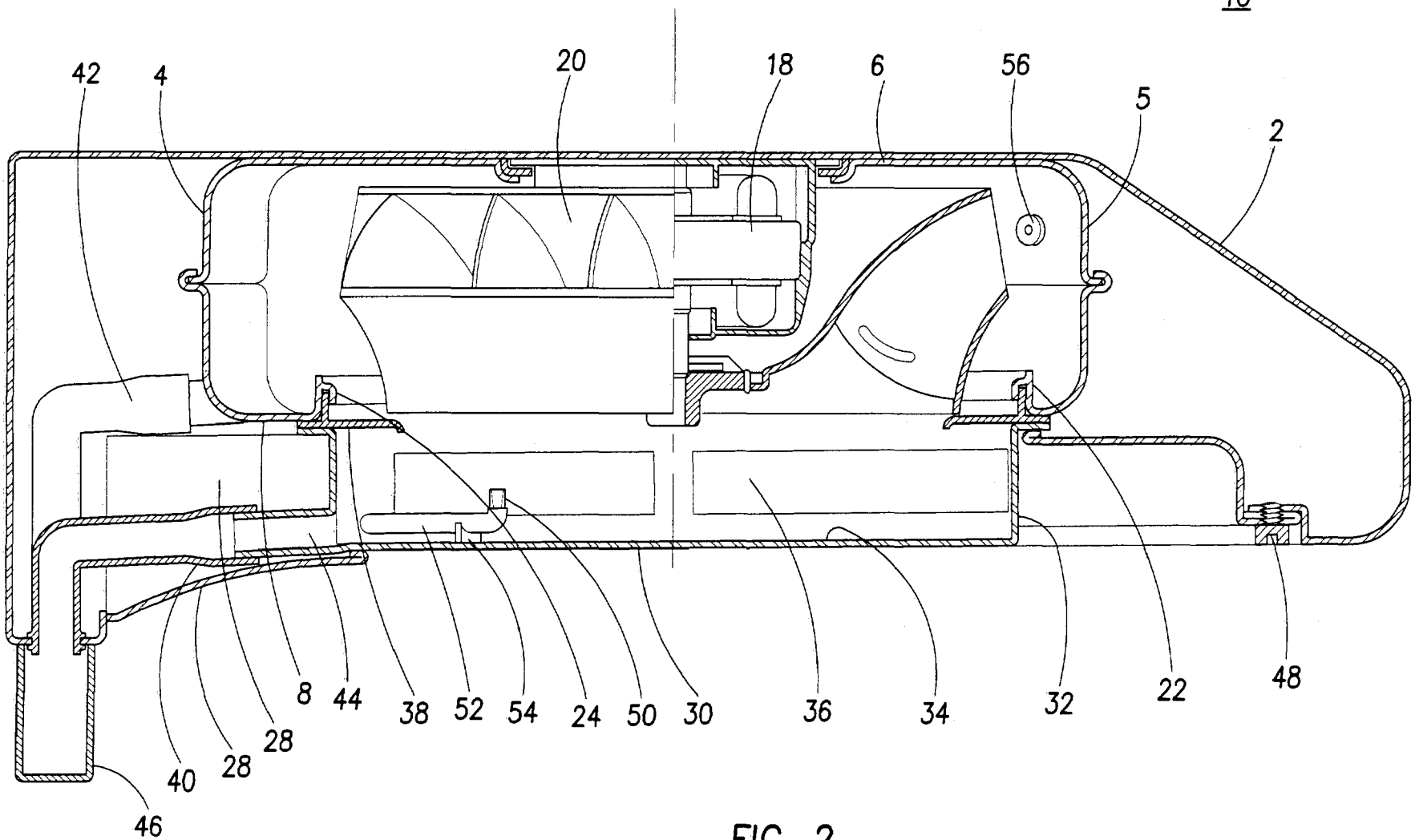
FIG. 2 is a side cross sectional view of the range hood of FIG. 1.
Figure 3:
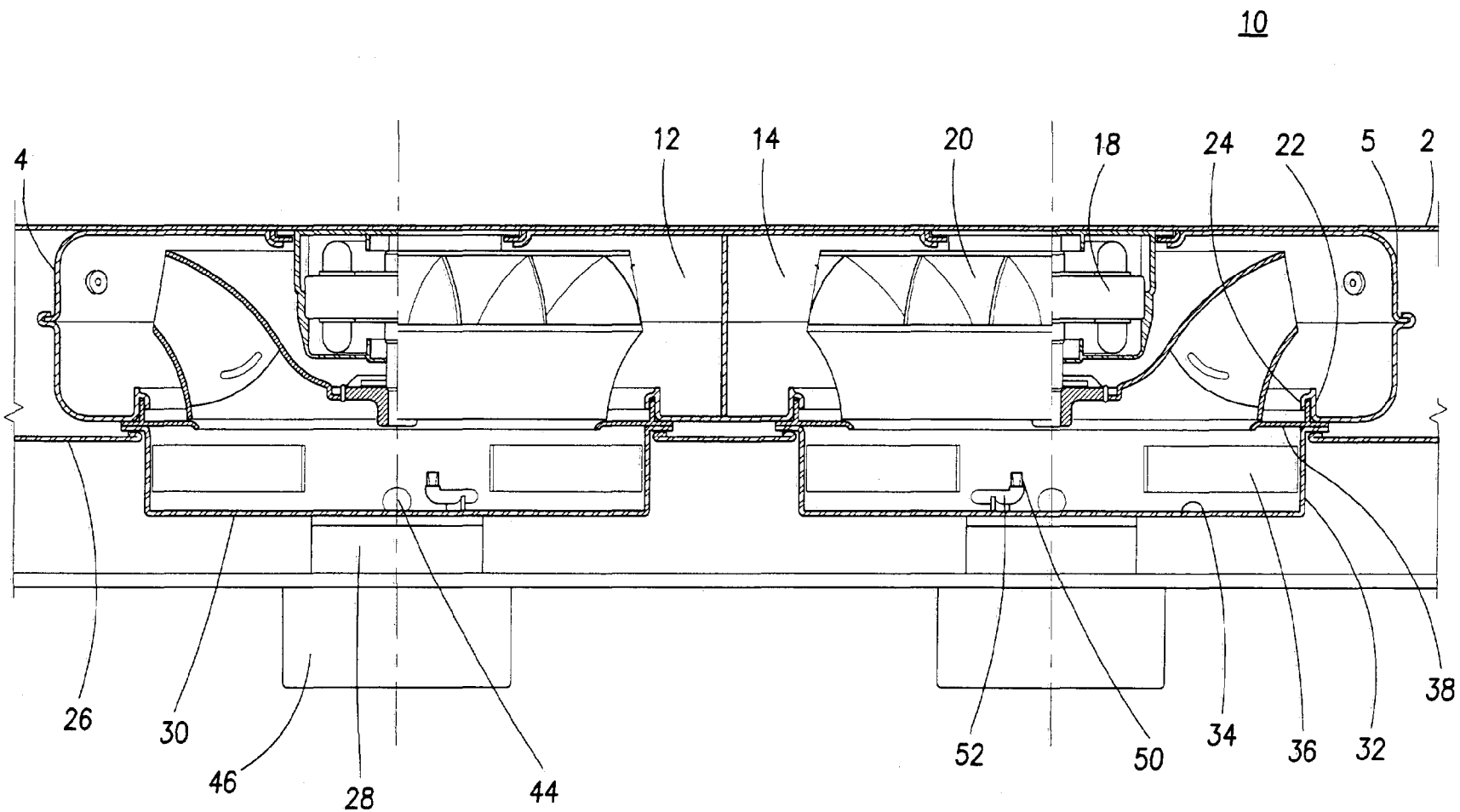
FIG. 3 is a front sectional view of the range hood shown in FIG. 1.

The preferred embodiment of a peripheral air drawing range hood 10 is illustrated in FIGS. 1-3. The range hood has an outer hood body 2 defining top, front, rear, side and bottom surfaces and forming the outer shell of an enclosure within which a motor housing 5 is mounted, as shown best in FIG. 2. A tray 30 in abutment with motor housing 5 projects below a bottom panel 26 connected to the hood body 2 providing a peripheral air drawing effect as discussed in greater detail below.

A motor housing 5 having top surface 6, bottom surface 8 and perimeter side surface 4 is mounted within the hood body enclosure. The motor housing interior is separated into two substantially similar, separate chambers 12 and 14, as shown in FIG. 3. Each respective chamber 12, 14 has an air outlet or ventilation hole (not shown) in top surface 6 and a chamber opening defined by walls 22 depending and rising vertically from the bottom surface 8 of the motor housing 5. Each chamber is designed to accommodate a motor 18 and fan 20 which act to draw hot, grease laden air from above the cooking surface, into the chambers 12, 14 of the motor housing 5 and out the ventilation holes. Both the motor 18 and the motor housing 5 are adapted to be removably attached to the hood body 2. The fan 20 is removably connected to the motor 18. The motors 18 are positioned within the motor housing so that when the fans 20 are attached they are positioned above the openings defined in the bottom 8 of the motor housing.

Preferably, an outwardly and downwardly projecting extension or lip 24 depends from wall 22, so as to form a gap between the lip 24 and wall 22. Lip 24 may diverge from wall 22 such that the gap forms a wedge surface. The openings defined by walls 22 are dimensioned such that the fans 20 fit through them.

Tray 30 has a tray wall 32 and a floor 34 forming a unitary structure. Floor 34 is planar, with tray wall 32 extending upwards from the outer perimeter of the floor 34. As shown in the FIGS., tray 30 is at least as large as the opening in the bottom surface 8 of the motor housing 5. A plurality of air inlet openings 36 are located about tray wall 32 spaced above the floor 34. Preferably, tray 30 is welded to an annular ring 38, such that the ring forms part of the tray. Alternatively the ring 38 and tray 30 may be formed from one molded or machined piece depending on the material with which it is made. Annular ring 38 is adapted to be inserted into the gap between the lip 24 and wall 22 and has a horizontal portion extending radially inwards so as to sit below the base of the fan 20 as shown in FIGS. 2 and 3. Preferably the radially inner edge of the annular ring 38 is downwardly facing such that any liquid collecting on the annular ring drains to the floor 34 of the tray 30.

Other designs are contemplated provided solely that the tray is in abutment with the motor housing below the opening in the bottom surface 8 and that it projects below bottom panel 26. For example, tray wall 32 could be directly insertable into the gap between lip 24 and wall 22. Further alternative embodiments will be discussed below.

The range hood 10 is equipped with an automatic cleaning system comprising spray dispensing means. Specifically, the motor housing has nozzles 56 seated in the perimeter side surface 4 through which cleaning fluid from a cleaning fluid source (not shown) is forced under pressure into the motor housing interior in order to clean grease laden surfaces. A further spray nozzle 50, to which a hose 52 passing through the tray wall 32 is connected, directs cleaning fluid under pressure towards the fan 20 and into the motor housing interior. Hose 52 is supported by wall 32 and hose support stand 54 projecting from the floor 34 so as to remain elevated above the tray floor 34.

Both the bottom surface 8 of the motor housing and the tray floor 34 are sloped from front to back so that any liquids drain towards the rear of the range hood. Liquids in the tray 30 drain to hole 44 through drainage hose 40 to external grease receptacle 46. Similarly, in the motor housing 5, liquids drain out a drainage hole (not shown) through drainage hose 42 to external grease receptacle 46. By raising the spray nozzle 50 and hose 52 above the level of the bottom of the motor housing, the stand 54 ensures that grease and liquid accumulating on the bottom of the motor housing are able to drain properly.

In order to form a complete range hood enclosure; range hood 10 has a bottom panel 26 that is releasably connected to the bottom of hood body 2 by way of quick release screws 48. Bottom panel 26 has openings corresponding to the trays 30 so as to encircle them; the tray wall 32 of the trays projecting through the bottom panel 26 such that the air inlets 36 are located below the panel 26 on the exterior of the hood body. A bottom panel compartment 28 acts to enclose the cleaning fluid and drainage hoses connected to the tray 30 and motor housing.

When the range hood is activated, the fans 20 act to draw air through the air inlets 36 in the tray walls 32. The suction is therefore directed about the periphery of the bottom of the range hood thereby acting to capture much of the grease laden gases that would normally escape around the sides of the range hood.

The cleaning system may be set to operate automatically at set intervals or through the push of a button while the range hood is operating. When activated, cleaning fluid from a source of cleaning fluid (not shown) is forced under pressure to nozzles 50, 56 where it is directed against grease laden surfaces. Because the range hood is operating during the cleaning process, air drawn in through the air inlets prevents any liquid from dripping out through the inlets to the cooking surface below. This greatly simplifies the cleaning process as compared to the range hoods of the prior art. A user need only be concerned with ensuring that the source of cleaning fluid remains full and that the grease receptacle be emptied as needed. Furthermore, should access to the interior of the motor housing be required for additional cleaning or maintenance purposes, a user need simply remove bottom panel 26 and tray 30.

The tray having peripheral air inlets and a cleaning system may be used in conjunction with a number of different fan and motor housing designs as will be discussed below. In discussing the alternative embodiments, identical reference numbers have been used to identify those elements that are identical to the preferred embodiment.

Figure 4:
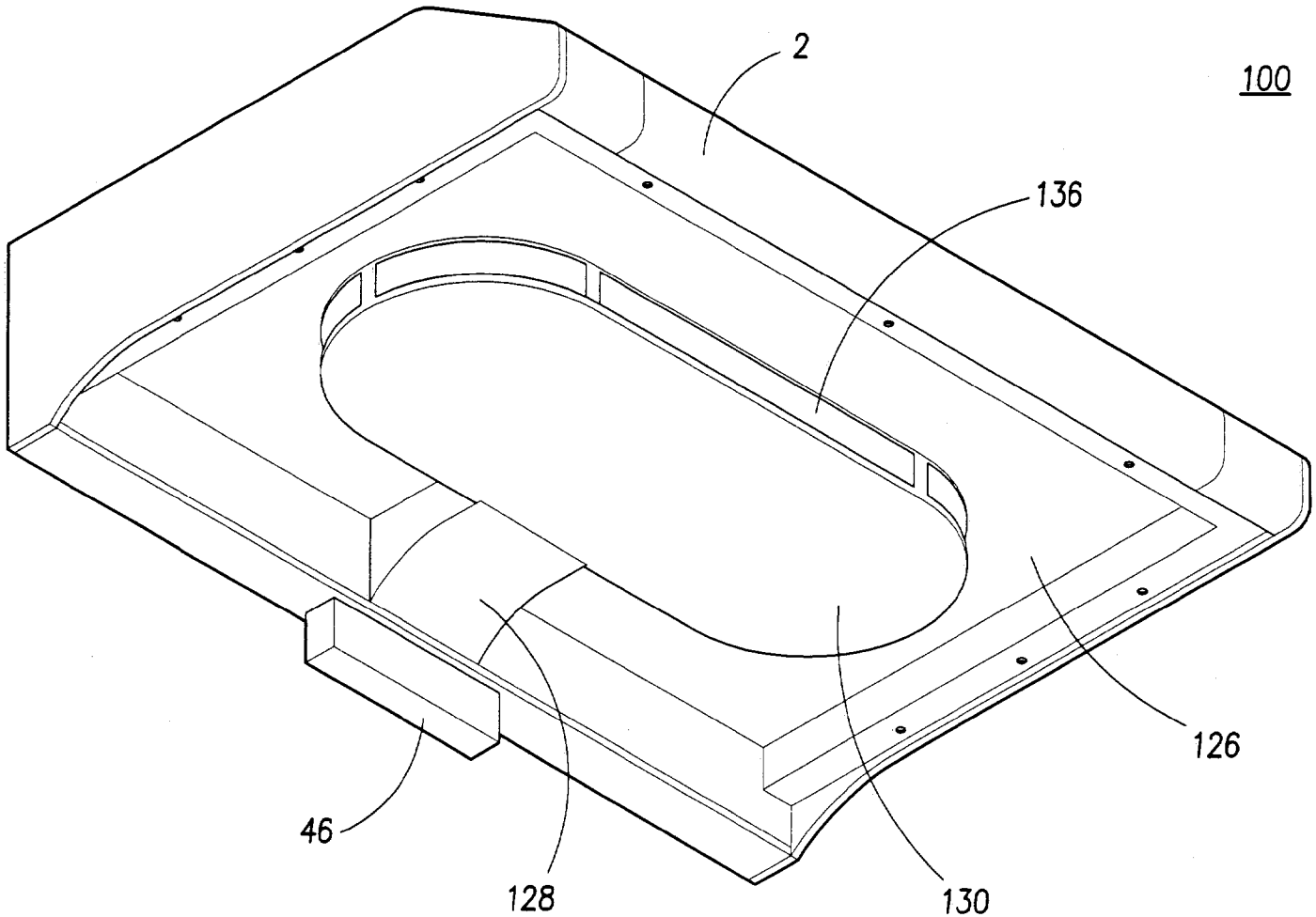
FIG. 4 is a perspective view from the bottom of a range hood according to an alternative embodiment of the invention.
Figure 5:
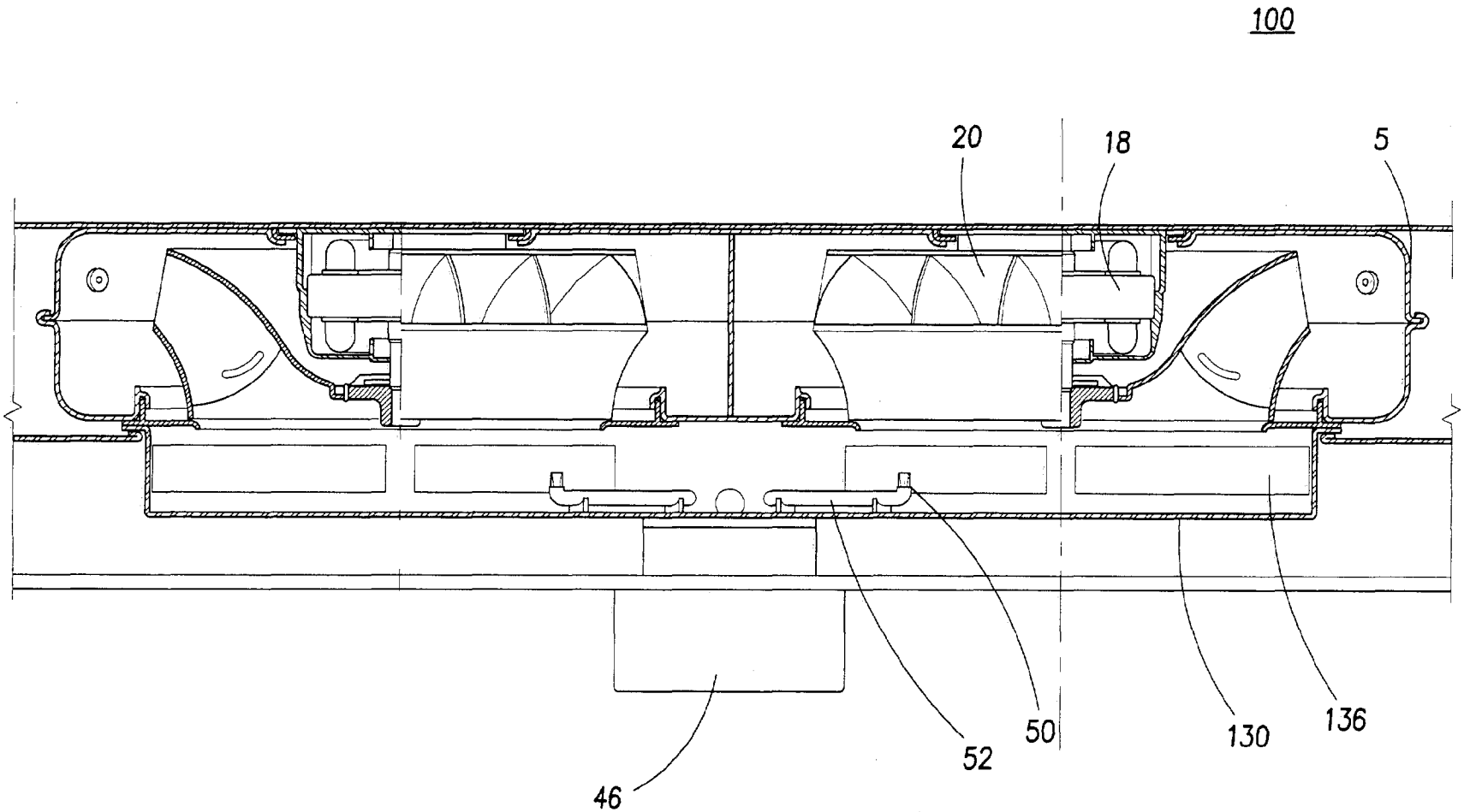
FIG. 5 is a front sectional view of the range hood shown in FIG. 4.

FIGS. 4 and 5 illustrate an alternative embodiment of a range hood 100 having a single tray 130 positioned below the openings in the motor housing 5. Tray 130 has air inlets 136 through which grease-laden gases are drawn from above the cooking surface into the motor housing before being exhausted to an external location. Tray 130 is equipped with at least a pair of hoses 52 and nozzles 50 in order to have one directed at each fan 20. Bottom panel 126 is adapted to fit about tray 130 when connected to hood body 2. Similarly, bottom panel compartment 128 is adapted to fit in abutment with the tray 130 so as to enclose any internal parts of the range hood such as hoses 52.

Figure 6:
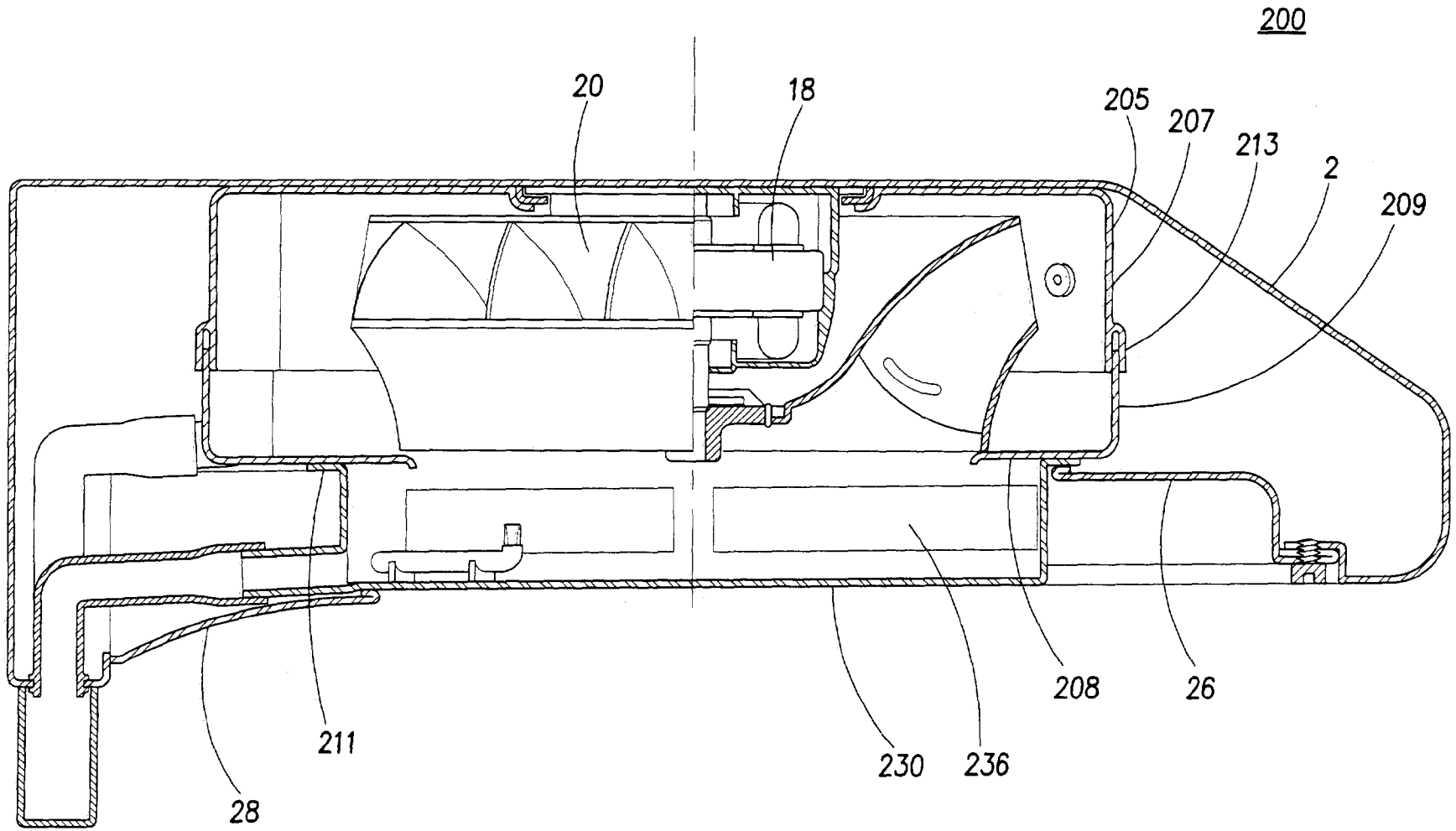
FIG. 6 is a side cross sectional view of a further alternative embodiment of a range hood according to the invention.

FIG. 6 illustrates a further alternative embodiment of a range hood 200. Range hood 200 has a motor housing 205 having a top section 207 and a bottom section 209 joined together at joint 213. The bottom surface 208 of the motor housing 205 has an opening defined therein corresponding to the intake portion of the fan 20. The bottom surface of the motor housing is sloped radially inwards so that any liquids accumulating in the motor housing interior drain through the opening in bottom surface 208 and into tray 230. In order to remove fan 20 from the motor housing, the bottom section 209 need simply be disconnected from top section 207. Tray 230 may be welded or otherwise secured, including releasably, by connecting upper flange 211 to bottom surface 208. Grease-laden air is drawn into the range hood through tray air inlets 236. Tray 230 is sloped from front to back so that accumulated liquid drains out to the grease receptacle.

Figure 7:
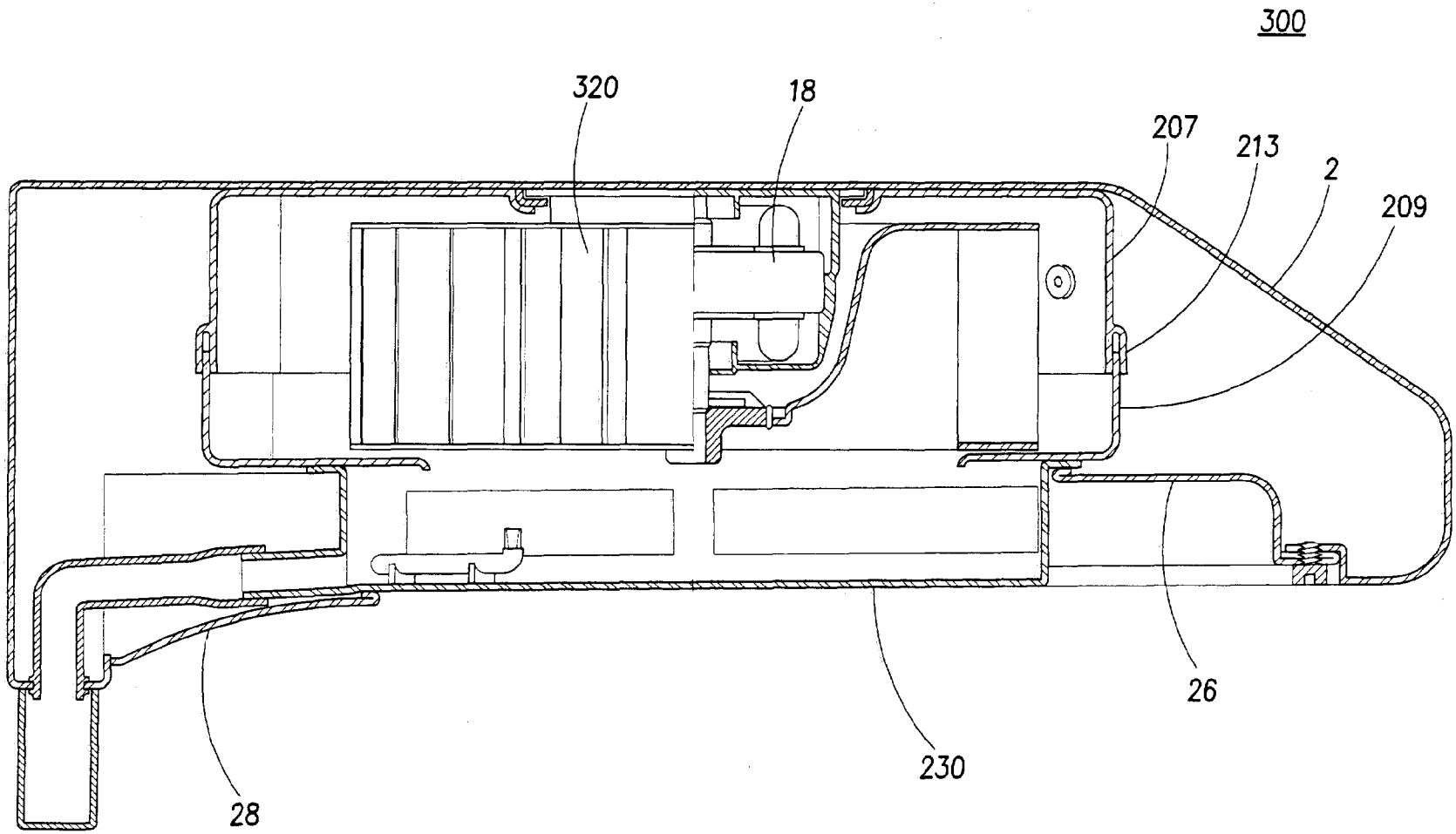
FIG. 7 is a side cross sectional view of a further alternative embodiment of a range hood according to the invention.

FIG. 7 illustrates a further alternative embodiment of a range hood 300 that is similar to range hood 200 shown in FIG. 6 except that it is equipped with a fan 320 of the squirrel cage type rather than fan 20 of the semi-impeller type.

Figure 8:
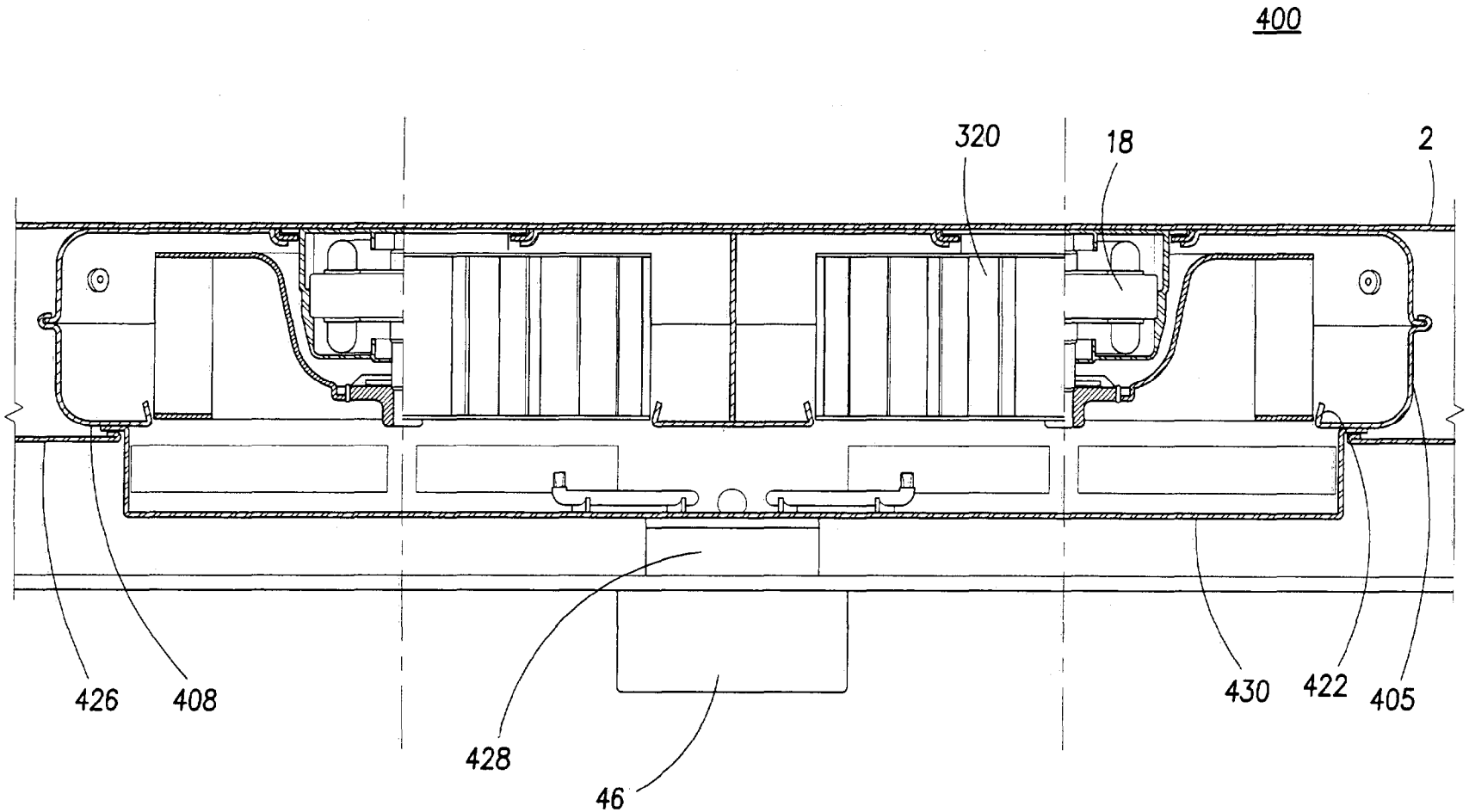
FIG. 8 is a front sectional view of a further alternative embodiment of a range hood according to the invention.

FIG. 8 shows yet a further alternative embodiment of a range hood 400 according to the invention. Range hood 400 is equipped with squirrel cage fans 320. The motor housing 405 does not have a bottom that may be removed as in range hood 300. Accordingly, the openings defined in bottom surface 408 must be sufficiently large to allow fans 320 to pass through. Angled walls 422 depend from bottom surface 408 extending into the motor housing interior and angling radially outward. Tray 430 is connected to bottom surface 408 by way of clips (not shown) or the like, with additional securement provided by bottom panel 426 when it is connected to the hood body 2. Wall 422 prevents any liquids within the motor housing from passing back through the opening in the bottom surface 408. Because they are sloped radially outwards, walls 422 also act to prevent any air forced into the motor housing by fans 320 from passing back out of the motor housing between the bottom surface 408 and the lower edge of fans 320.

Figure 9:
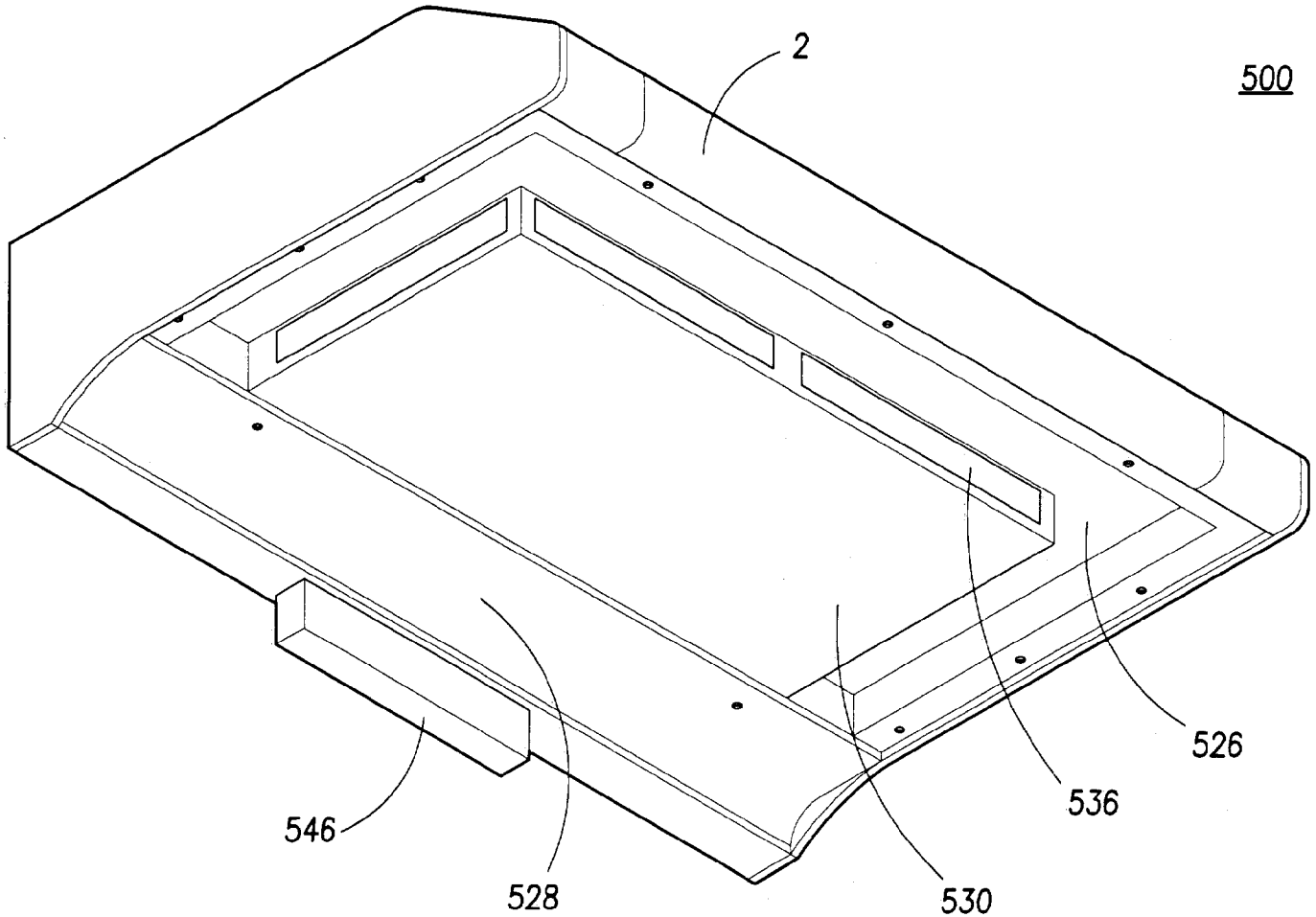
FIG. 9 is a perspective view from the bottom of a range hood according to yet a further alternative embodiment of the invention.

Finally, FIG. 9 illustrates yet a further alternative embodiment of a range hood 500 according to the invention. Range hood 500 has a generally rectangular tray 530 with air inlets 536. Bottom panel 526 connects to the hood body about tray 530. A further compartment panel 528 connects to the hood body and to bottom panel 526 so as to enclose, while providing space for, the inner workings of the range hood.

As the greasy air enters the range hood some of the grease condenses on the bottom panel. Grease on the bottom panel may be easily wiped off as necessary. Grease within the motor housing drains to the bottom of the motor housing and may be cleaned as discussed above. Preferably the motor housing is made of metal and is coated to prevent rust. The motor housing is also preferably coated with a non-stick material so as to facilitate grease removal. It is also contemplated that plastic or the like may be used for certain portions of the range hood.

While the invention disclosed is a two motor range hood, it is contemplated that the combination of the tray having air inlets located about its wall and a cleaning system could also be incorporated in range hoods having only a single motor.

It will be appreciated by those skilled in the art that the preferred and alternative embodiments have been described in some detail but that certain modifications may be practiced without departing from the principles of the invention.

What is claimed is:

1. A range hood for exhausting gases comprising:

an outer hood body;

a motor housing having top, bottom and perimeter surfaces defining an enclosure and having an air outlet and at least one opening defined in said bottom surface, said motor housing being mounted within said hood body;

a motor and a fan mounted within said enclosure of said motor housing;

a unitary tray having a perimeter side wall, a planar floor and a drainage hole, said perimeter side wall extending upwards from the outer perimeter of said floor, at least one air inlet opening being located in said perimeter side wall, said tray being releasably connected to and in abutment with said motor housing such that said planar floor is located below said opening in said bottom surface, said tray being sized to be at least as large as said opening in said bottom surface; and a bottom panel releasably connectable to said hood body.

2. The range hood of claim 1 wherein when said bottom panel is connected to said hood body said perimeter side wall of said tray projects through an opening in said bottom panel such that said at least one air inlet is located below said bottom panel.

3. The range hood of claim 1 wherein said perimeter side wall extending from said floor and terminating in an annular ring, said annular ring connecting to said motor housing and having a horizontal portion extending radially inward so as to be positioned below a portion of said fan, said horizontal portion terminating in a downwardly extending edge.

4. The range hood of claim 1 further comprising spray dispensing means.

5. The range hood of claim 1 further comprising a hose and spray nozzle, said hose being seated in said side wall of said tray and said nozzle being positioned so as to direct cleaning fluid under pressure towards said fan and motor housing interior.

6. The range hood of claim 5 wherein said hose and nozzle are further seated on a support stand projecting from said floor of said tray.

7. The range hood of claim 1 wherein said tray wall has a plurality of said air inlets.

8. The range hood of claim 1 comprising two of said motors and two of said fans and wherein said motor housing comprises two substantially similar air chambers, each chamber having one of said at least one openings defined in said bottom surface, a motor and fan being housed within each chamber above said openings.

9. The range hood of claim 8 wherein said tray is adapted to encompass both said openings.

10. The range hood of claim 8 further comprising two of said trays, one tray positioned below a first of said air chambers and a second tray positioned below a second of said air chambers.

* * * * *